US005636777A

United States Patent [19]

Semeia

[11] Patent Number: 5,636,777

[45] Date of Patent: Jun. 10, 1997

[54] SUPPORT DEVICE, IN PARTICULAR FOR DIVING EQUIPMENT PARTS

[75] Inventor: Roberto Semeia, San Salvatore Di Cogorno, Italy

[73] Assignee: Scubapro Europe S.r.l., Italy

[21] Appl. No.: 394,949

[22] Filed: Feb. 27, 1995

[30] Foreign Application Priority Data

Mar. 4, 1994 [IT] Italy ..... GE940010 U

[51] Int. Cl.[6] ..... A45C 15/00; A45F 4/00

[52] U.S. Cl. ..... 224/575; 224/220; 224/250; 224/269; 224/934; 405/186

[58] Field of Search ..... 128/202.14, 207.14, 128/207.16, 204.26, 912, 201.11, 861; 224/151, 220, 250, 252, 269, 575, 934; 405/186, 187; 24/459, 482, 542, 537, 20 S, 17 B, 19

[56] References Cited

U.S. PATENT DOCUMENTS

| | | | |
|---|---|---|---|
| 3,269,129 | 8/1966 | Zambrano | 224/934 |
| 4,028,778 | 6/1977 | Bardoni et al. | 24/79 |
| 4,062,356 | 12/1977 | Merrifield | 128/205.22 |
| 4,079,735 | 3/1978 | Gaffney | 128/142.2 |
| 4,334,642 | 6/1982 | Reisch | 224/37 |
| 4,339,060 | 7/1982 | Braida, Jr. | 224/32 R |
| 4,877,167 | 10/1989 | McNemar | 224/269 |
| 4,919,631 | 4/1990 | Stafford | 405/186 |

FOREIGN PATENT DOCUMENTS

| | | |
|---|---|---|
| 1.064.372 | 5/1954 | France . |
| 38 14 868 | 11/1989 | Germany . |
| 89/11810 | 12/1989 | WIPO . |

*Primary Examiner*—Henry J. Recla
*Assistant Examiner*—Timothy L. Maust
*Attorney, Agent, or Firm*—Larson and Taylor

[57] ABSTRACT

A support device, in particular for diving equipment parts, and of the type intended to be carried by the diver, comprises a clamping clip (1) which can be elastically opened and which grips the equipment part (2), and means (3, 4) for securing the clip (1) to a part of the equipment which is worn (5), such as a garment, a jacket, or a part of the harness. The device is particularly useful, especially for supporting an emergency regulator (2), known as an octopus rig. For this purpose in particular, a cap (8) for closing off the air outlet hole in the mouthpiece of the emergency regulator (2), is attached to the device.

19 Claims, 2 Drawing Sheets

SUPPORT DEVICE, IN PARTICULAR FOR DIVING EQUIPMENT PARTS

The model relates to a support device, in particular for diving equipment parts, and especially of the type intended to be carried by the diver.

The object of the model is to produce a support device of the abovementioned type, which is simple to construct and inexpensive to manufacture, and which allows the equipment parts to be held securely, at the same time enabling them to be released easily and quickly from the support device, where appropriate also by pulling them off.

A particular object of the model is to produce a support device of the type described at the outset, which is designed to support an emergency regulator, known as an octopus rig.

The model achieves the objects set forth above by means of a support device of the type described at the outset which comprises a clamping clip which can be elastically opened and which grips the equipment part, and means for securing the clamping clip to a part of the equipment intended to be worn, such as a garment, a wet-suit or drysuit, a belt, a jacket or other parts of the diver's harness.

The securing means can consist of an eyelet which is integral with the clamping clip and via which the said clip can be fixed either directly to the part of the equipment which is to be worn, or by means of hooking means, which are preferably removable and can be engaged on the one hand in the eyelet which is integral with the clamping clip and on the other hand are either fixed directly to the part of the equipment which is to be worn or can in turn be engaged in eyelets, clips, or the like which are integral with the said part of the equipment which is to be worn. For example, the said hooking means can consist of snap-links, cords or the like.

According to a further characteristic of the model, which relates to using the device for supporting an emergency regulator known as an octopus rig, the clamping clip has a specific shape which follows that of at least part of the said regulator, i.e. of the approximately cylindrical part of the body of the latter, while the support device carries in addition a cap for closing off the air outlet hole in the mouthpiece of the emergency regulator, which cap is advantageously attached to the clamping clip by means of a flexible strip so that it can assume a rest position in which it takes up very little space.

The advantages of the model will be evident from the above text. Firstly, the clamping clip which can be elastically opened enables the accessory part to be locked firmly in place. The clamping force is calibrated so that the said part is securely locked in place and so that the accessory can be released extremely quickly, simply by pulling it out of the clamping clip. In addition the locking device can be hooked or fixed to a part of the diver's body which enables the accessory to be easily located. This proves to be particularly advantageous in the case in which the said accessory is an emergency regulator.

Given that the emergency regulator remains inactive for long periods of time, since it is only used sporadically in case of need, the cap which closes off the air outlet hole in the regulator prevents foreign particles or bodies, which may damage the emergency regulator or cause it to malfunction, from entering the said hole.

Advantageously, disengageable means such as, for example, snap-links or the like, are preferably used as the hooking means for the support device. This enables the support device to be unhooked from the part of the equipment which is worn without detaching it from the emergency regulator, thereby protecting, the emergency regulator from the entry of foreign bodies even out of its use environment.

The model has further characteristics which form the subject of the subclaims.

The characteristics of the model and the advantages deriving therefrom will be made clearer in the following description of an embodiment illustrated in the appended drawings, in which.

Figure 2:
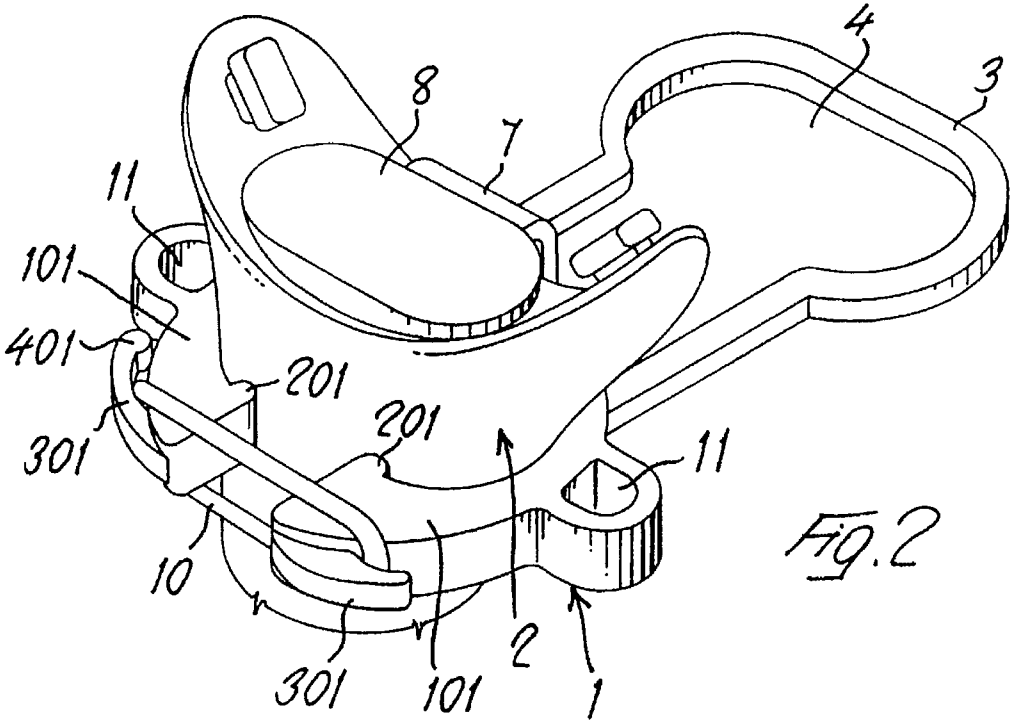
FIG. 2 illustrates, in perspective and on an enlarged scale, the device according to FIG. 1, with the emergency regulator engaged therein.
Figure 1:
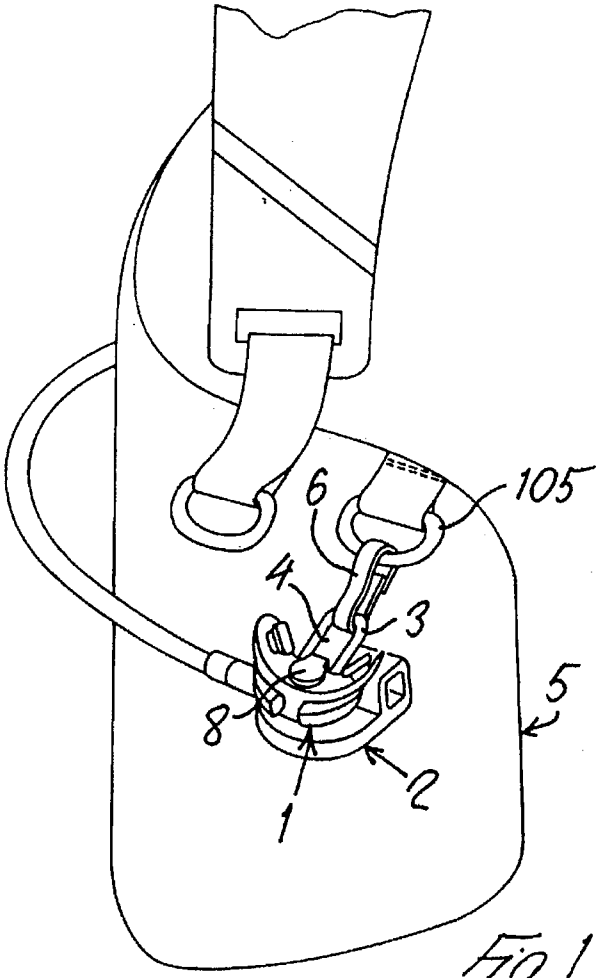
FIG. 1 illustrates a perspective view of the device according to the model, hooked on to a part of the harness and in which an emergency regulator is engaged.

With reference to the figures, a support device for diving equipment parts, which is especially intended to support an emergency regulator known as an octopus rig, comprises a clamping clip 1, the jaws or arms 101 of which can be elastically opened. The clamping clip 1 is basically in the shape of an open ring or a "C", with curved arms or jaws 101, in particular its shape basically complementing that of the body of the emergency regulator 2, a basically cylindrical part of which is designed to engage in the said clip.

Extending from the closed rear side of the clamping clip 1 is an additional "U"-shaped clip 3 which forms an eyelet 4 for the engagement of means which hook onto a part of the equipment intended to be worn by the diver, such as for example a wet suit or dry suit, a harness, a jacket 5, or the like. In the example illustrated the hooking means advantageously consist of a snap-link 6 which is fixed to a ring 105 integral with the harness 5. The use of the snap-link 6 enables the support device to be released from the harness 5, while remaining attached to the emergency regulator 2. Advantageously, the ring 105 can be provided on a part of the harness 5 where the emergency regulator 2 is easily and immediately accessible once the diver has put the harness on.

A cap 8 for closing off the air outlet hole in the mouthpiece of the emergency regulator 2 is provided inside the eyelet 4, at the free end of a flexible strip 7 which is connected to the middle of the closed rear side of the clamping clip 1.

Figure 3:
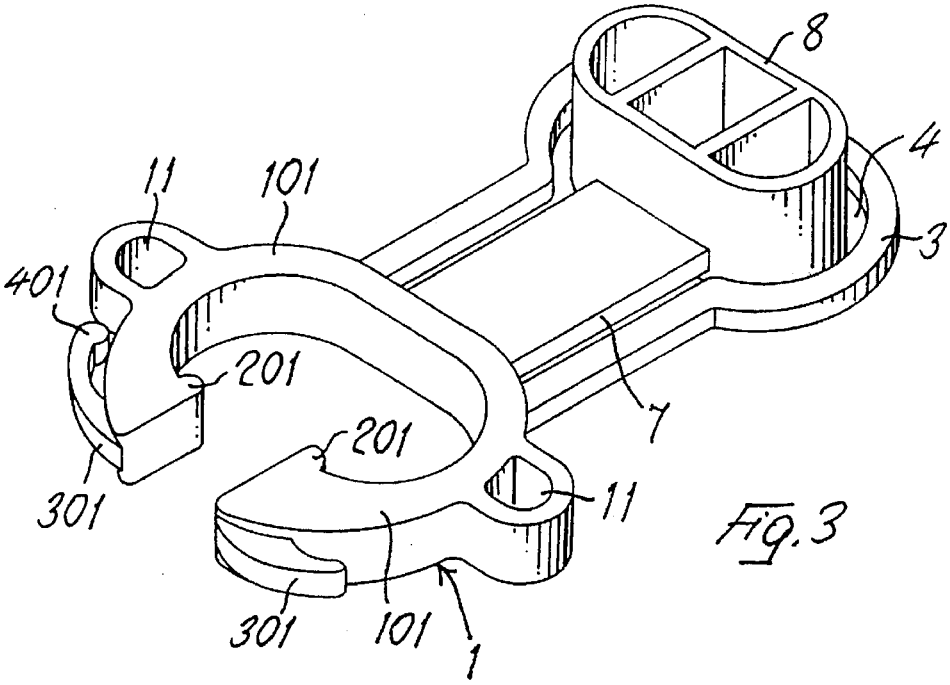
FIG. 3 is a view similar to that of FIG. 2 showing the support device on its own.
Figure 4:
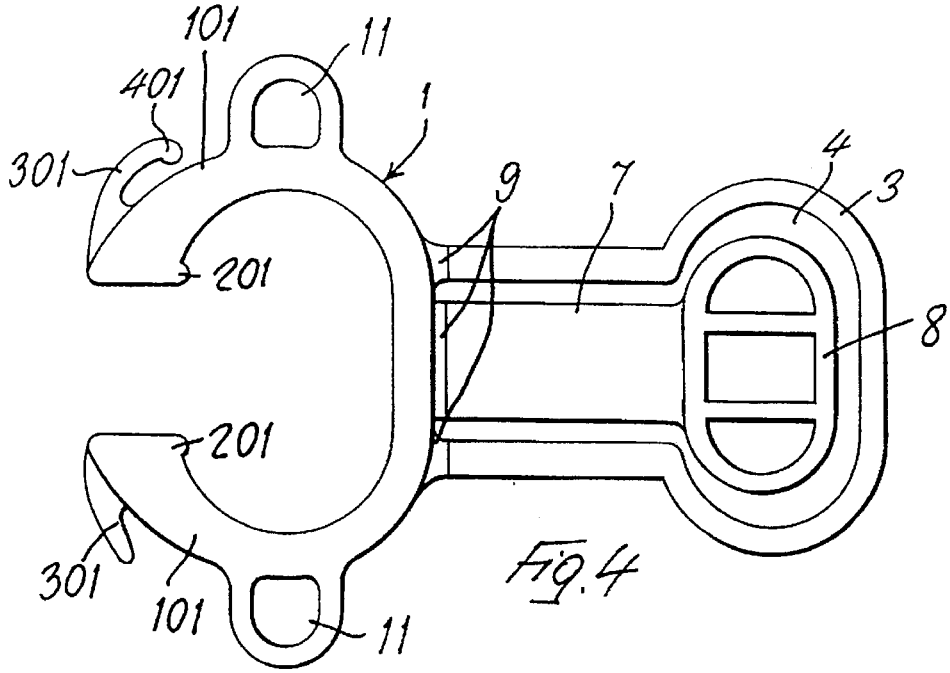
FIG. 4 is a plan view from above of the support device according to the preceding figures.
Figure 5:
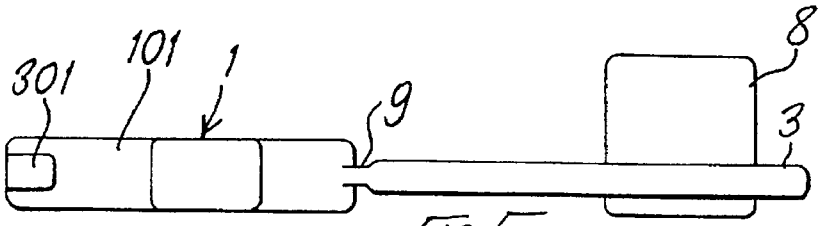
FIG. 5 is a side view of the support device according to the preceding figures.

As may be seen in FIGS. 3 to 5, the clamping clip 1, the U-shaped clip 3 and the flexible strip 7 in the rest position are arranged so that they are basically coplanar with one another, giving the support device a flattened and relatively thin shape which takes up very little space. The flexible strip 7 and the U-shaped clip 3 are connected to the rear side of the clamping clip 1 via a thinned part 9 in the form of a film hinge. The cap 8 is made so that its shape is complementary to that of the air outlet hole in the mouthpiece of the emergency regulator 2 so that it fits therein by means of elastic coupling and as a result of its shape, while the shape of the eyelet 4 matches that of the cap 8.

According to a further characteristic of the model, the internal side of each of the free ends of the arms or jaws 101 of the clamping clip 1 bears a rounded projection 201 which forms a dimensionally limited surface, producing a forced clamping action. On the external side of these same ends of the arms or jaws 101, hooking teeth 301 are provided which engage with means providing an additional clamping action and preventing the arms 101 from opening up.

The clamping means are preferably elastic and such that they allow the emergency regulator 2 to be released from the clamping clip 1 by pulling it out with a certain degree of force. In particular the clamping means consist of an elastic ring 10 (FIG. 2). One of the hooking teeth 301 is made so that it engages with the hooking means 10 in a stable and advantageously optionally releasable manner, while the other hooking tooth 301 is made so that it engages with the hooking means 10 in a removable manner. In the example illustrated they consist of tongues which extend away from each other on the free end of the respective arm 101 of the clamping clip 1, basically tangential to the latter, thereby forming an engagement recess for the elastic ring 10. One of the two tongues has a projection 401 at its free end, this projection preventing the ring 10 from slipping off and being in the form of a curl or an enlarged head which partly closes off the opening to the engagement recess, the tongue being elastically flexible outwards in order to allow the elastic ring 10 to be engaged-and disengaged.

According to a further improvement, one or more additional eyelets 11 are provided on the external side of the arms or jaws 101 of the clamping clip 1, in particular in the middle of the arms or jaws, which eyelets can be used for hooking on additional equipment parts or for engaging additional means with which to lock the accessory in place, optionally an accessory other than the emergency regulator 2 housed in the clamping clip 1. This is because, in addition to supporting the emergency regulator 2, the device according to the model can be used to support additional diving equipment accessories, for example torches or the like. In this case the means 10 for clamping the arms or jaws 101 of the clamping clip, the internal projections 201 and the additional eyelets 11, prove extremely advantageous in compensating for the slight differences in size between the said accessories and the regulator 2, for which the clamping clip 1 is particularly suited, and in providing additional means with which to lock the accessory in place on the said clip.

The device according to the model is advantageously made as a single piece and of plastic.

I claim:

1. A support device for diving equipment parts comprising:

a clamping clip comprising a pair of elastically openable jaws for gripping an equipment part, each of said jaws including at least one aperture on an external side; and securing means for securing said clamping clip to an item worn by a diver, said securing means comprising a U-shaped eyelet attached to a rear part of said clamping clip and hooking means engaging said U-shaped eyelet.

2. The support device according to claim 1 further comprising additional clamping means and wherein each of said jaws further includes at least one hooking tooth for engaging said additional clamping means whereby said jaws are prevented from opening.

3. The device according to claim 1 wherein said jaws are curved and free ends of said jaws terminate at a distance from each other whereby said clamping clip has a shape of an open ring.

4. The device according to claim 1 wherein each of said jaws further includes a projection extending inwardly for producing a forced clamping action on an equipment part gripped by said clamping clip.

5. A support device according to claim 1 wherein said U-shaped eyelet is elastically pivotable with respect to said clamping clip.

6. A support device according to claim 5 wherein said clamping clip and said U-shaped eyelet are coplanar.

7. A support device for diving equipment parts in combination with an emergency regulator comprising:

a clamping clip comprising a pair of elastically openable jaws for gripping an equipment part;

securing means for securing said clamping clip to an item worn by a diver;

a cap attached to said support device for closing off an air outlet hole of said emergency regulator; and a flexible strip for securing said cap to said clamping clip.

8. The device according to claim 7 wherein a shape and size of the clamping clip complement a shape and size of a cylindrical part of the emergency regulator.

9. The device according to claim 7 further comprising a film hinge for connecting the flexible strip to the clamping clip.

10. The device according to claim 9 wherein said securing means comprises a U-shaped eyelet attached to a rear part of said clamping clip.

11. The device according to claim 10 wherein the flexible strip is coplanar with said clamping clip and with the U-shaped eyelet when the cap is not covering the air outlet hole.

12. The device according to claim 11 wherein the U-shaped eyelet includes a section having a shape matching a shape of said cap for housing said cap and the flexible strip.

13. A support device for diving equipment parts comprising:

a clamping clip comprising a pair of elastically openable jaws for gripping an equipment part, each of said jaws including at least one aperture on an external side;

securing means for securing said clamping clip to an item worn by a diver;

additional means for clamping; and wherein each of said jaws further includes at least one hooking tooth for engaging said additional means for clamping whereby said jaws are prevented from opening.

14. The support device according to claim 13 wherein the hooking tooth in one of said jaws is fixed and the hooking tooth in the other of said jaws is elastically flexible outward for allowing said additional clamping means to be engaged and disengaged.

15. The support device according to claim 13 wherein said additional clamping means comprises an elastic ring.

16. The support device according to claim 15 wherein each of said hooking teeth comprises a tongue extending outward from a free end of the respective jaw to form an engagement recess for receiving the elastic ring, one of said tonguies being elastically flexible outward and including an anti-slip projection on a free end thereof, said anti-slip projection partly closing off said engagement recess for preventing said ring from slipping off of said clamping clip.

17. A support device for diving equipment parts comprising:

a clamping clip comprising a pair of elastically openable jaws for gripping an equipment part, wherein said jaws are curved and free ends of said jaws terminate at a distance from each other whereby said clamping clip has a shape of an open ring, each of said jaws including at least one aperture on an external side, each of said jaws further including a protection extending inwardly for producing a forced clamping action on an equipment part gripped by said clamping clip; and securing means for securing said clamping clip to an item worn by a diver.

18. A support device for diving equipment parts comprising:

a clamping clip comprising a pair of elastically openable jaws for gripping an equipment part, each of said jaws including at least one aperture on an external side and a projection extending inwardly for producing a forced clamping action on an equipment part gripped by said clamping clip; and securing means for securing said clamping clip to an item worn by a diver.

19. A support device for diving equipment parts in combination with an emergency regulator comprising:

a clamping clip comprising a pair of elastically openable jaws for gripping an equipment part, wherein a shape and size of the clamping clip complement a shape and size of a cylindrical part of the emergency regulator;

securing means for securing said clamping clip to an item worn by a diver; and a cap attached to said support device for closing off an air outlet hole of said emergency regulator.

* * * * *